US006537183B1

(12) United States Patent
McCrea

(10) Patent No.: US 6,537,183 B1
(45) Date of Patent: Mar. 25, 2003

(54) COMBINATION HAND WEIGHT AND ROPE PULL DEVICE

(76) Inventor: James McCrea, 204 Los Gatos Blvd., Los Gatos, CA (US) 95032

( * ) Notice: Subject to any disclaimer, the term of this patent is extended or adjusted under 35 U.S.C. 154(b) by 0 days.

(21) Appl. No.: 10/046,875

(22) Filed: Jan. 14, 2002

Related U.S. Application Data

(63) Continuation-in-part of application No. 09/844,899, filed on Apr. 26, 2001.

(51) Int. Cl.[7] ..... A63B 21/075
(52) U.S. Cl. ..... 482/106
(58) Field of Search ..... 482/102–108, 482/127, 148

(56) References Cited

U.S. PATENT DOCUMENTS

| | | | | | |
|---|---|---|---|---|---|
| 359,994 | A | * | 3/1887 | Brunner | 482/108 |
| 590,050 | A | * | 9/1897 | Webb | 482/108 |
| 768,581 | A | * | 8/1904 | Burks et al. | 482/108 |
| 1,416,741 | A | * | 5/1922 | Nicholls et al. | 482/127 |
| 1,583,261 | A | * | 5/1926 | Sence | 482/108 |
| 2,821,394 | A | * | 1/1958 | Barbeau | 482/127 |
| 4,484,741 | A | * | 11/1984 | Bingisser | 272/131 |
| 4,618,142 | A | * | 10/1986 | Joseph, Jr. | 272/75 |
| 4,871,165 | A | * | 10/1989 | Marshall et al. | 272/132 |
| 5,437,591 | A | * | 8/1995 | Chen | 482/127 |
| 5,618,249 | A | * | 4/1997 | Marshall | 482/127 |
| 5,733,231 | A | * | 3/1998 | Corn et al. | 482/120 |
| 5,876,310 | A | * | 3/1999 | Mackey et al. | 482/74 |
| 6,149,559 | A | * | 11/2000 | Mackey | 482/124 |
| 6,336,894 | B1 | * | 1/2002 | Kestila | 482/99 |

* cited by examiner

*Primary Examiner*—Nicholas D. Lucchesi
*Assistant Examiner*—Lori Baker Amerson
(74) *Attorney, Agent, or Firm*—The Kline Law Firm

(57) ABSTRACT

A combination hand weight and rope pull device that includes a pair of hand weights. The two weights can be used independently, or they can be joined by at least one rope attached to a rotor in the weight head. The heads rotate through an unlimited arc so that the ropes do not bind when the device is in use. If, as in the standard model, each of the weights is equipped with only one active head with a rotor, one or two ropes may be used in parallel to add resistance to the hand weights. In a first alternate embodiment, each of the weight heads is equipped with a rotor (four total). Typically, a pair of the ropes are joined together in series with a joining element so that two or four ropes may be employed. The joining elements can be disconnected so that the pair of weights can be used individually. In a second alternate embodiment, each of the weight heads are aiso equipped with a rotor (four total). However, in this embodiment, the units are joined in parallel, rather than in series so that one to four ropes may be used. The total number of available resistance levels is therefore five (zero to four ropes utilized).

7 Claims, 12 Drawing Sheets

COMBINATION HAND WEIGHT AND ROPE PULL DEVICE

This application is a continuation-in-part of Applicant's co-pending application Ser. No. 09/844,899, filed Apr. 26, 2001.

BACKGROUND OF THE INVENTION

1. Field of the Invention

The present invention relates generally to handheld resistance training devices, and more particularly is a combination hand weight and rope pull device. The resistance for the rope pull aspect of the device is adjustable.

2. Description of the Prior Art

Health and fitness technology is a very active field. Numerous and varied inventions have been made to help a person train more efficiently in order to get the maximum benefit in the minimum amount of time.

One of the most common forms of exercise is simply walking. It has been learned by fitness experts that there are benefits gained by walking with weights held in the user's hands. While it is possible to gain at least some of these benefits by simply carrying a given weight while one walks, many prior art devices are directed to hand weight devices that enhance and make a walking workout more efficient.

Many of the prior art devices recognize that it is beneficial to connect two hand resistance devices in order to synchronize the user's motions. Accordingly, there have been devices generated that use a mounting device affixed around the user's waist. One such device is the "Upper Body Exercise Device" of Mackey, et al., U.S. Pat. No. 5,876,310, issued Mar. 2, 1999. Other inventors, recognizing that the hands do not naturally move in a plane parallel to the waist, have added extension means to allow the hands to move in more natural arcs. An example of such a device is the "Unidirectionally Adjustably Resistant Recoilers and Portable Exercise Devices" of Marshall, U.S. Pat. No. 5,618,249, issued Apr. 8, 1997.

The Marshall device, as well as many others including the "Exercise Device with Variable Resistance" of Corn et al., U.S. Pat. No. 5,733,231, include means to vary the resistance of the handheld device. The need to vary resistance to maximize the benefit of an exercise is recognized in many other prior art devices as well. Two such inventions are the "Variable Resistance Exercise Device" of Mackey, U.S. Pat. No. 6,149,559, issued Nov. 21, 2000, and the "Portable Friction Resistant Exercise Device" of Marshall et al., U.S. Pat. No. 4,871,165, issued Oct. 3, 1989.

The prior art devices universally use a waist or hip mounted apparatus to supply the connection means between the two handheld devices. These devices tend to force the user's hands into unnatural positions during the exercises, and are bulky and cumbersome to carry and transport. Further, the prior art variable resistance mechanisms are quite complex, therefore being difficult and expensive to manufacture, and they can add significant size and weight to the device.

Accordingly, it is an object of the present invention to provide a hand weight device with a variable resistance means.

It is a further object of the present invention to provide a device that allows the user to move his hands in a natural arc while using the device.

It is a still further object of the present invention to provide a device that provides a constant resistance, that is, resistance is present when the user's hands are moving both forward and backward.

SUMMARY OF THE INVENTION

The present invention is a combination hand weight and rope pull device comprising a pair of hand weights. The two weights can be used independently, or they can be joined by at least one rope attached to a rotor in the weight head. The heads rotate so that the ropes do not bind when the device is in use. The rotation of the heads is unlimited.

If, as in the standard model, each of the weights is equipped with only one active head with a rotor, one or two ropes may be used to add resistance to the hand weights. In an alternate embodiment, each of the weight heads is equipped with a rotor (four total), so that one to four ropes may be employed. The total number of available resistance levels is therefore five (zero to four ropes).

An advantage of the present invention is that it can be used as a set of hand weight, or in combination as a rope pull device.

Another advantage of the present invention is that the resistance between the two hand weights is variable.

A still further advantage of the present invention is that the design of the device yields a streamlined, not bulky, exercise machine. Further, the simplicity of the design reduces manufacturing complexity, and therefore manufacturing cost.

Still another advantage of the present invention is that a user may employ the device with a natural motion of his arms and hands.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
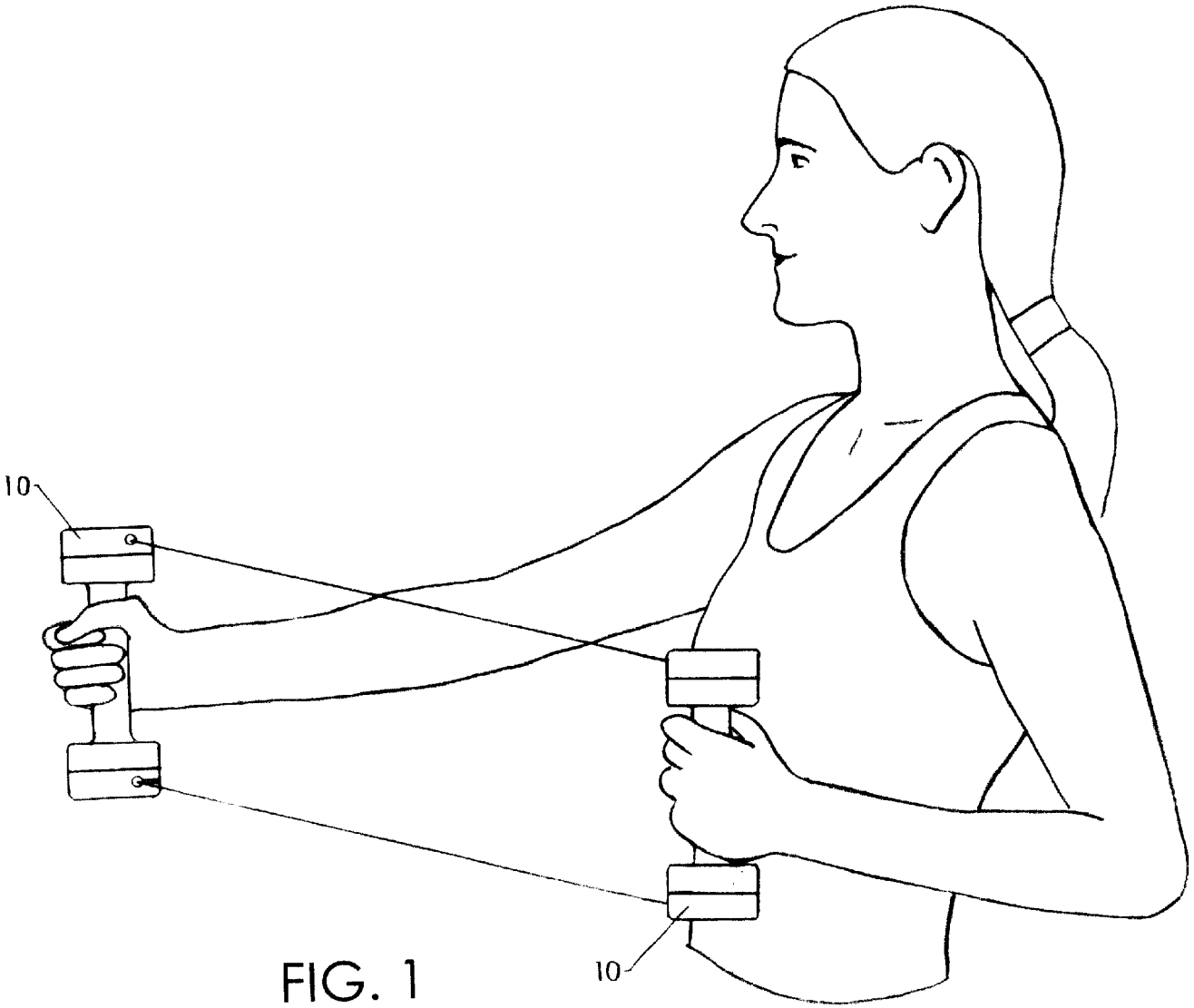
FIG. 1 is a perspective view of the combination hand weight and rope pull device of the present invention in use.
Figure 2:
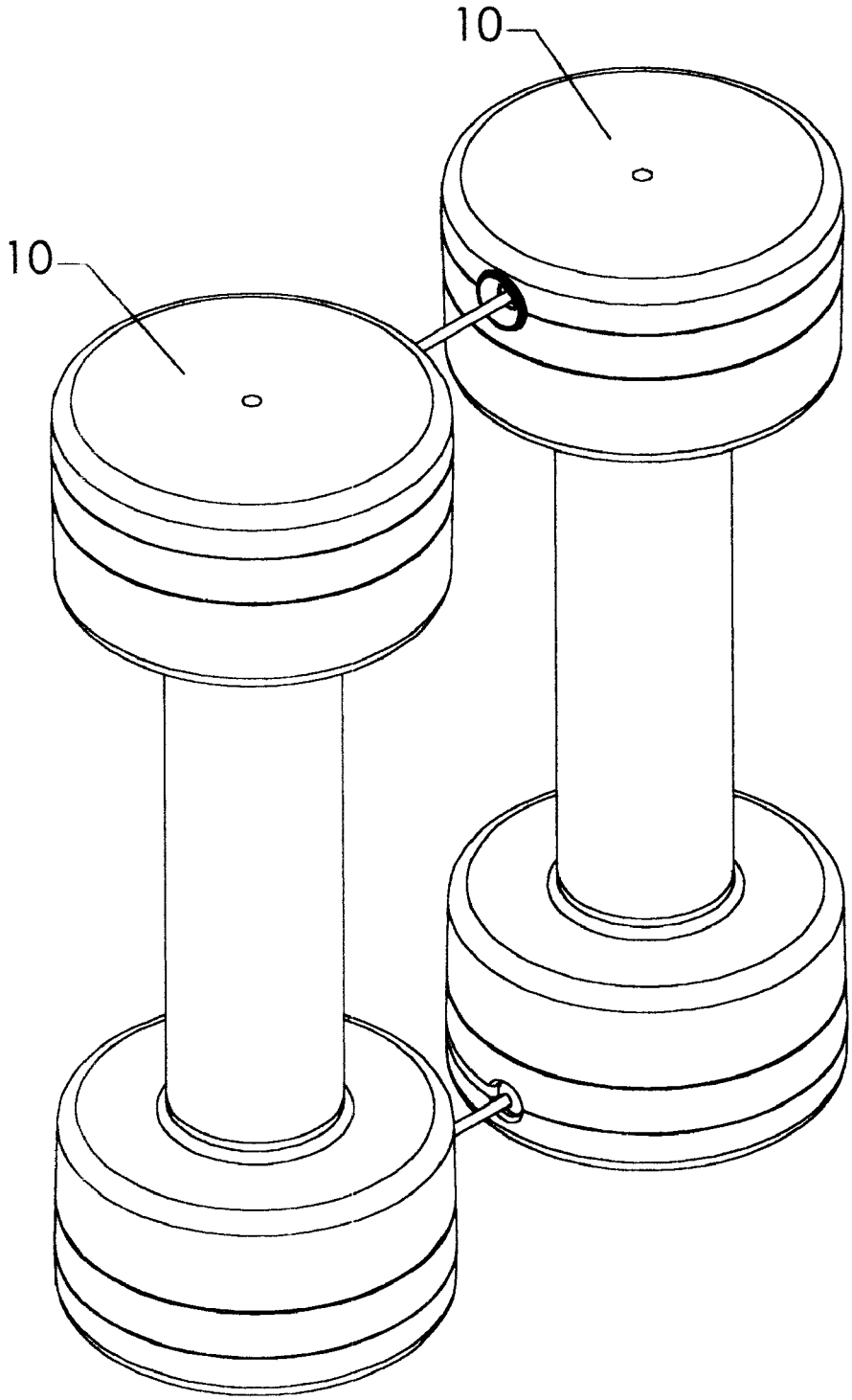
FIG. 2 is a perspective view of the device.
Figure 4:
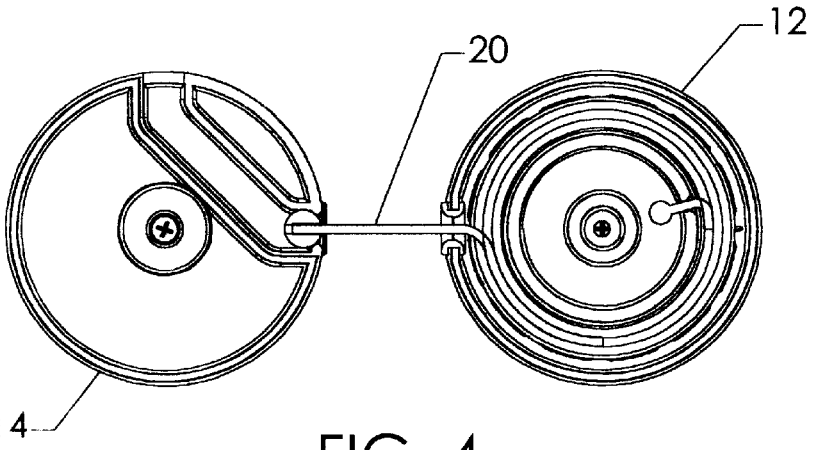
FIG. 4 is a sectional view taken along line 4—4 in FIG. 3 showing the interior of the head of the device.
Figure 3:
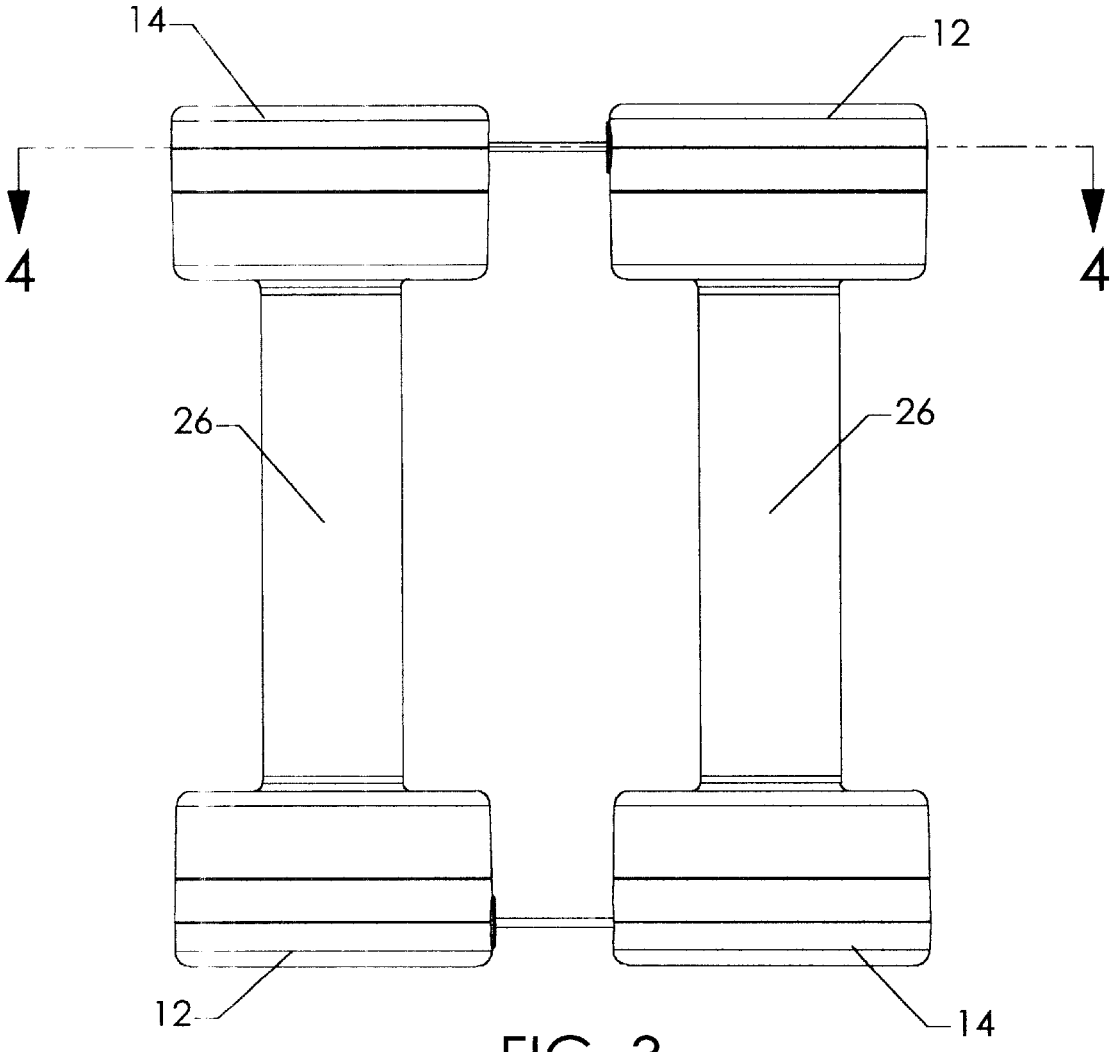
FIG. 3 is a side view of the device.
Figure 7:
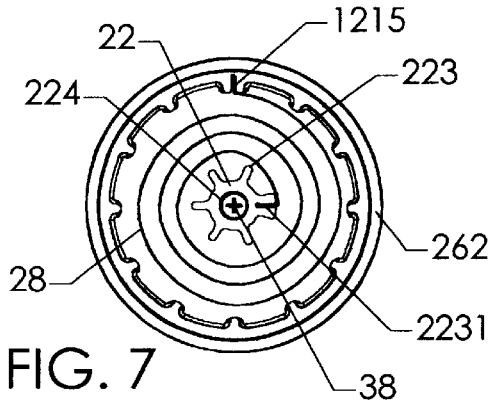
FIG. 7 is a sectional view along line 7—7 in FIG. 5.
Figure 6:
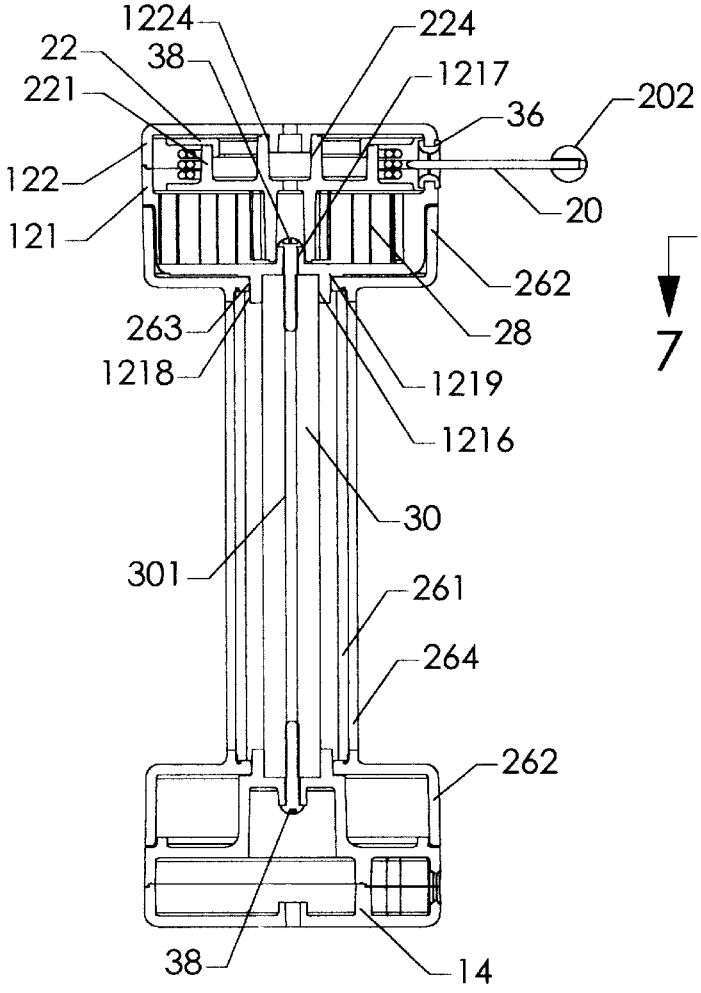
FIG. 6 is a sectional view along line 6—6 in FIG. 5.
Figure 5:
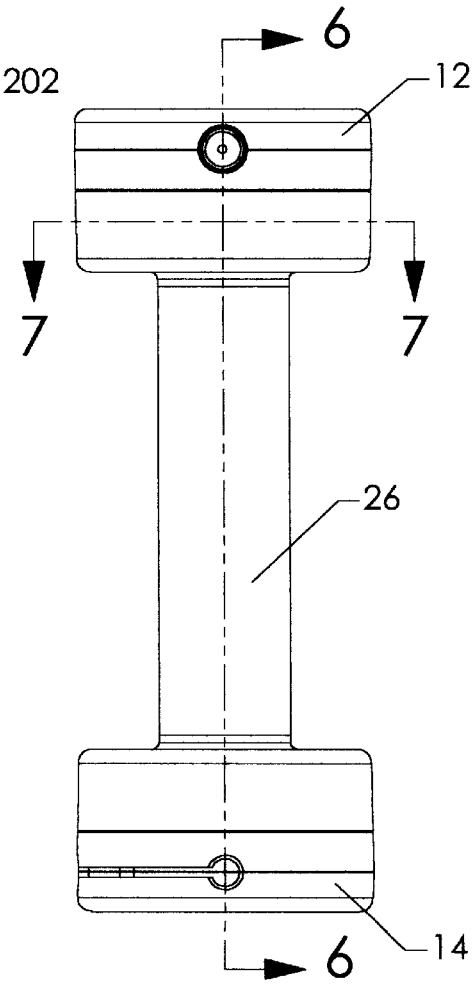
FIG. 5 is a front view of a handle assembly.
Figure 8:
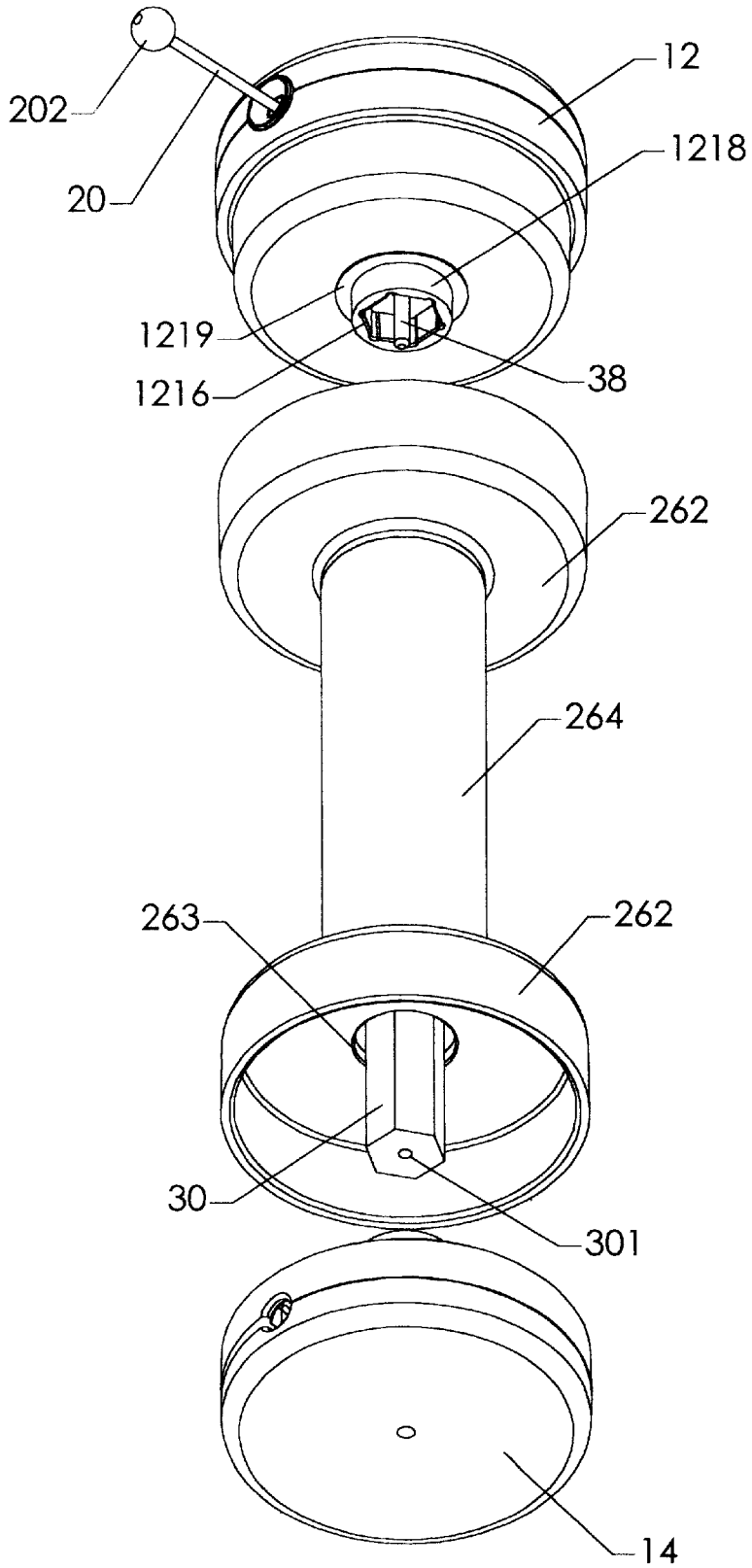
FIG. 8 is an exploded view of one of the handle assemblies.
Figure 9:
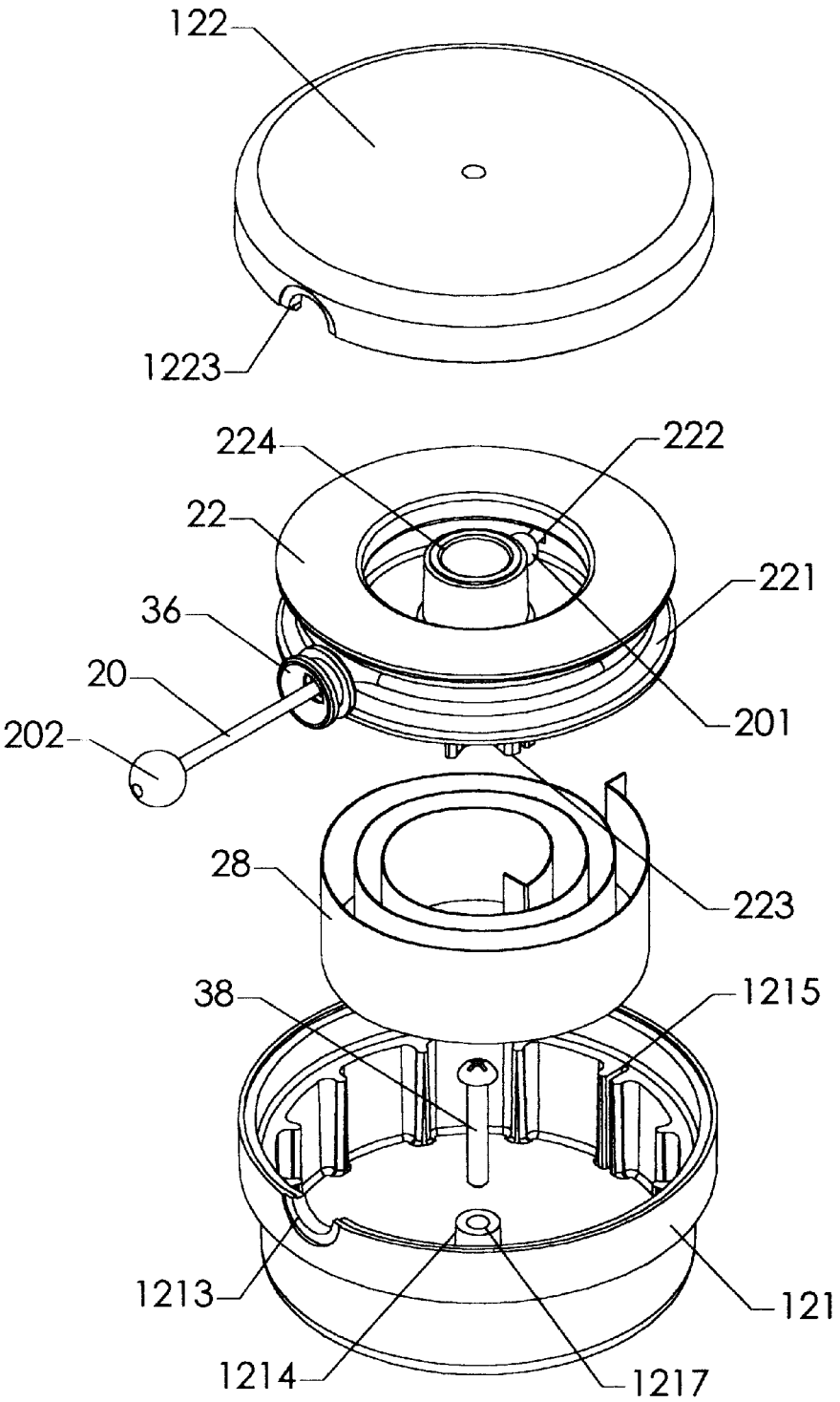
FIG. 9 is an exploded view of the head assembly of the device.

Referring first to FIGS. 1–9, the first preferred embodiment of the present invention is a combination hand weight and rope pull device comprising a pair of hand weights 10. Each weight 10 comprises an active head 12 and a dummy head 14 situated at each end of a handle 26. The two hand weights 10 can be used independently, but more typically they will be joined by one or two ropes 20. A first end of each rope 20 is attached to a rotor 22 housed in an active head 12 mounted on handle 26, and the other end of the rope 20 is secured in the dummy head 14.

The handle 26 comprises a central body 261, a grip 264, and a pair of head bases 262. A connecting shaft passageway 263 is provided in the center of the handle 26. The central body 261 and the head bases 262 can of course be constructed as a unitary element, but more typically the central body 261 and the head bases 262 will be formed in multiple sections by injection molding for ease of manufacturing.

Referring chiefly now to FIGS. 6–9, the active head 12 of each weight 10 includes a rotor 22 in communication with a spiral wound spring 28. An inner end of the rope 20 is secured inside the rotor 22 by end stop 201. In the preferred embodiment, the end stop 201 is a knot in the rope 20. The rope 20 extends outward through a rope slot 222, and the rope 20 is wound around a reel 221 on the outer end of the rotor 22 and projects through rope guide 36. An end stop 202 is secured to the outer end of rope 20.

An arbor 223 on the inner portion of the rotor 22 receives the inner end of the spring 28 in slot 2231. The outer end of spring 28 is secured in a spring retaining slot 1215 in the wall of the inner active head shell 121.

Rotor 22 and rope guide 36 are captured between inner active head shell 121 and outer active head shell 122. Spring 28 is captured between rotor 22 and inner active head shell 121. Semicircular half holes 1213, 1223 in inner active head shell 121 and outer active head shell 122 respectively serve as a seat for rope guide 36. A central hole 224 is provided in each end of the rotor 22 to receive boss 1224 on outer active head shell 122 and boss 1214 on inner active head shell 121. Bosses 1224, 1214 act as bearing journals for rotor 22. Inner active head shell 121 and outer active head shell 122 are then joined together. While any known method of securing the two shells 121, 122 is acceptable, in the preferred embodiment, the shells 121, 122 are ultrasonically welded.

A central hex socket 1216 is positioned on the inner side of the inner active head shell 121. Active head 12 is placed on hex shaft 30 such that hex shaft 30 is received in hex socket 1216. The hex feature ensures that the active head 12, the dummy head 14, and the hex shaft 30 rotate together at all times. A screw 38 inserted through a screw hole 1217 in the top of the inner active head shell 121 threads into hole 301 in hex shaft 30, thus securing active head 12 to hex shaft 30.

A bearing journal 1218 comprises the exterior surface of hex socket 1216 such that when active head 12 is placed in handle 26, bearing journal 1218 fits into the bearing 263 of head bases 262.

For ease of construction, the structure of the dummy head 14 is identical to that of the active head 12 in most respects. However, the active resistance elements, the rotor 22 and the spring 28, are omitted. Therefore, the dummy head 14 of the first hand weight 10 serves only as an anchoring means for an outer end stop 202 of a second rope 20 whose inner end is secured in the active head 12 of the second hand weight 10. Dummy head 14 is placed on an opposite end of hex shaft 30 relative to active head 12 such that handle 26 is mounted between a dummy head 14 and an active head 12.

The rotatable heads 12, 14 of the present invention allow the user to use the device through a wide range of motion. As the angle between the two hand weights 10 changes, the heads 12, 14 rotate so that the ropes 20 do not bind on the rope guides 36. The rotors 22 in combination with the wound springs 28 provide resistance to the hand weights 10 as the user exercises.

First Alternate Embodiment

Figure 11:
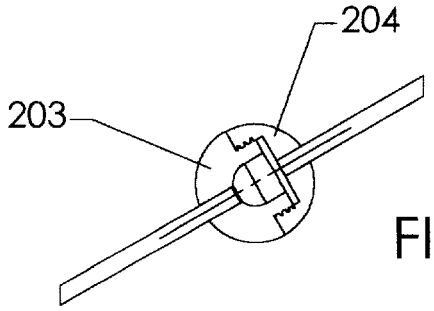
FIG. 11 is a detail view of the joining element of the first alternate embodiment.
Figure 10:
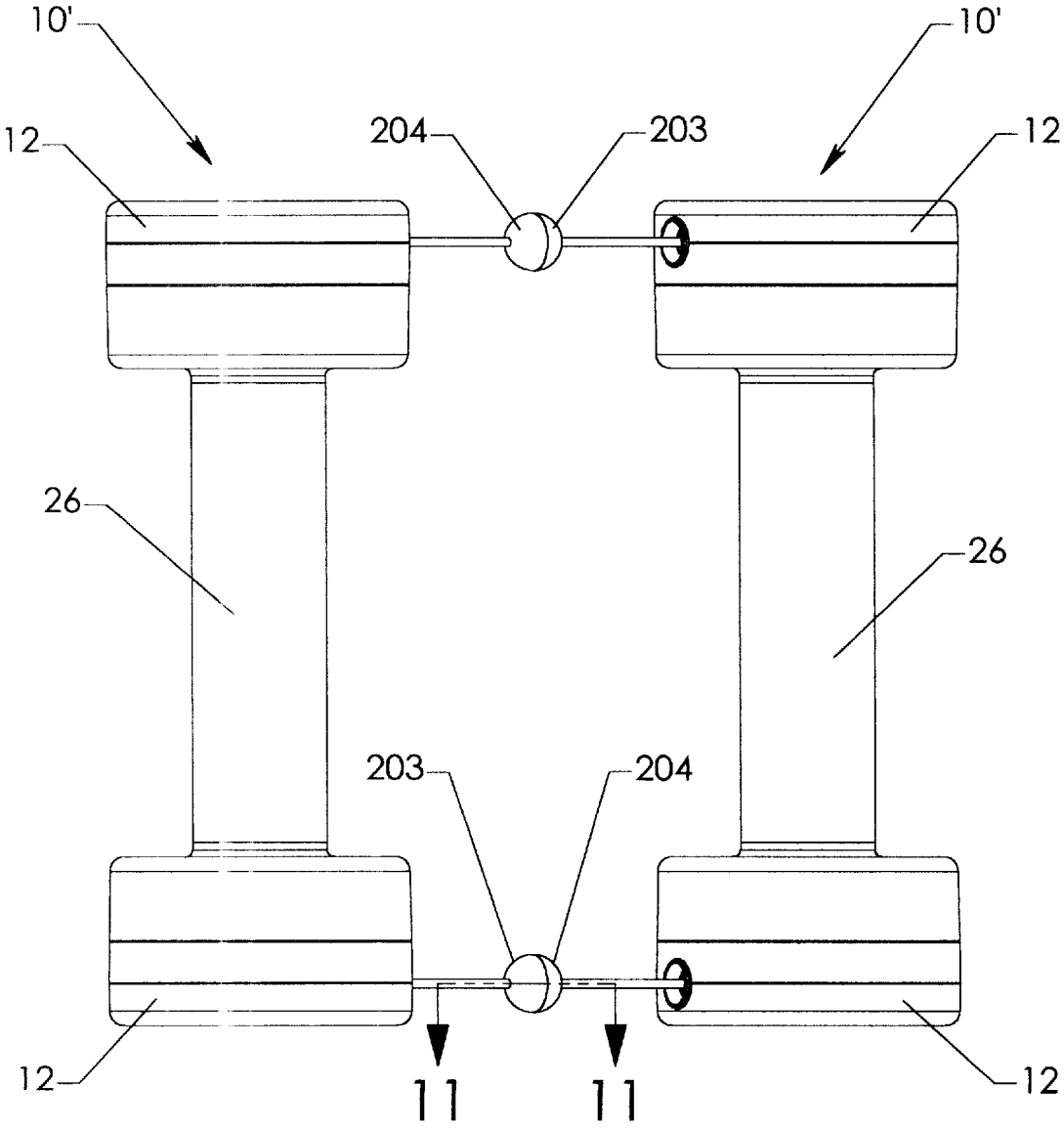
FIG. 10 shows a perspective view of a first alternate embodiment of the device.
Figure 12:
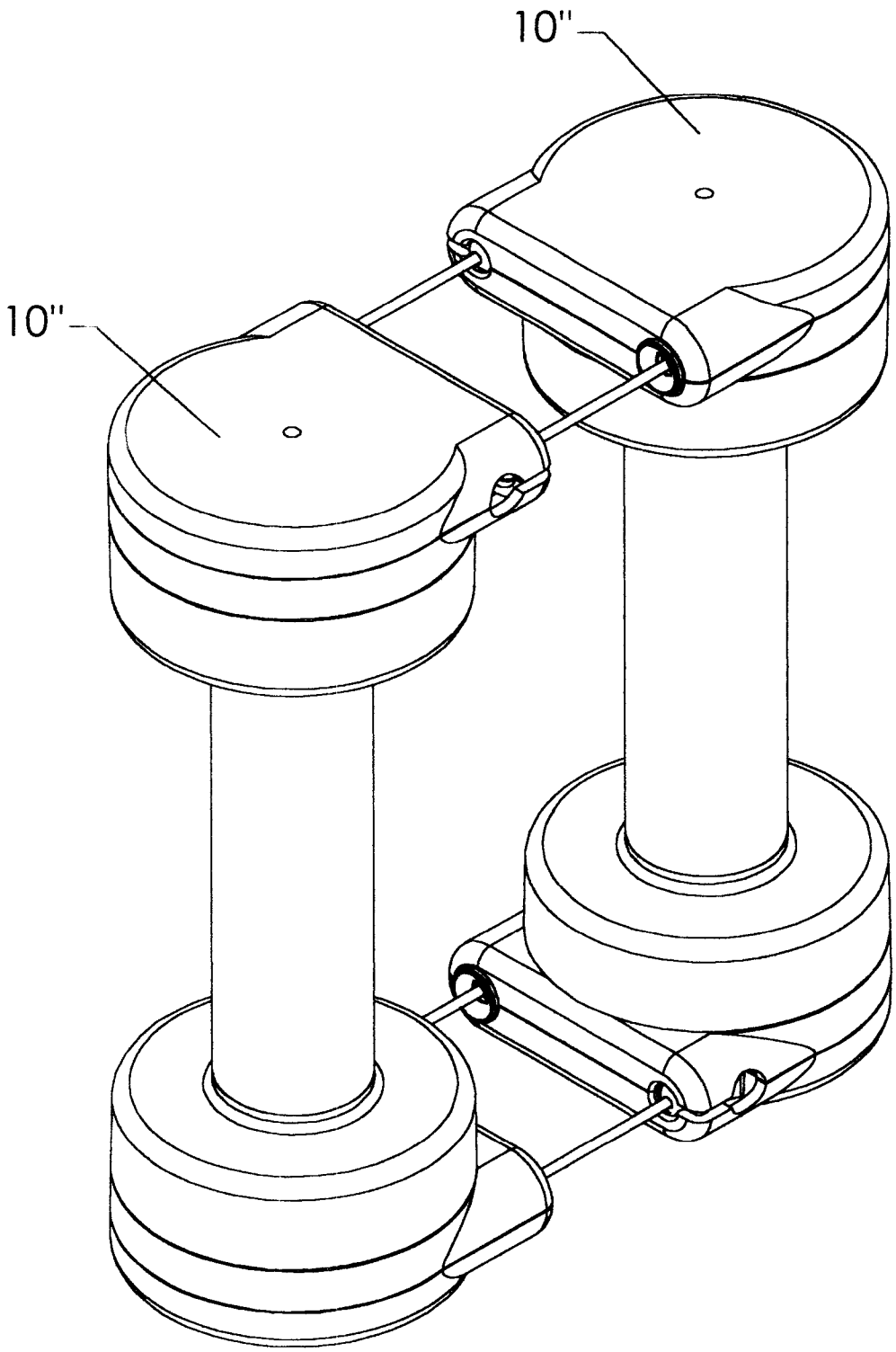
FIG. 12 is a perspective view of a second alternate embodiment of the present invention.
Figure 14:
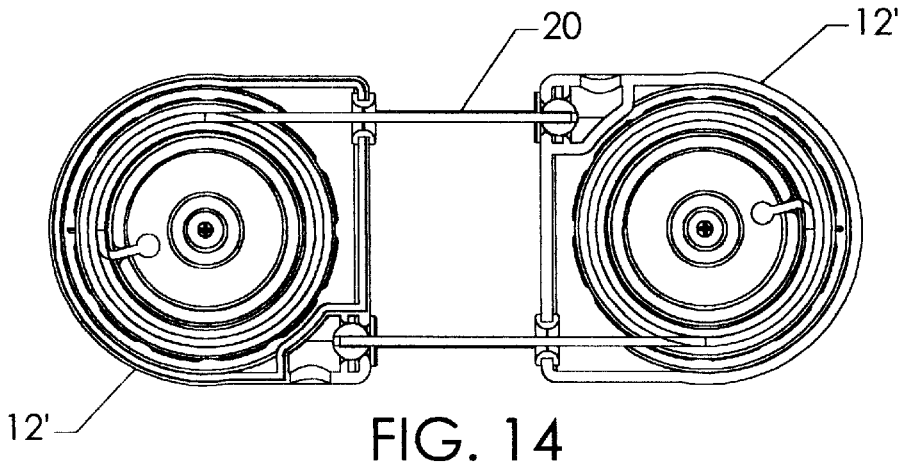
FIG. 14 is a sectional view taken along line 14—14 in FIG. 13 showing the interior of the head of the device of the second alternate embodiment.
Figure 13:
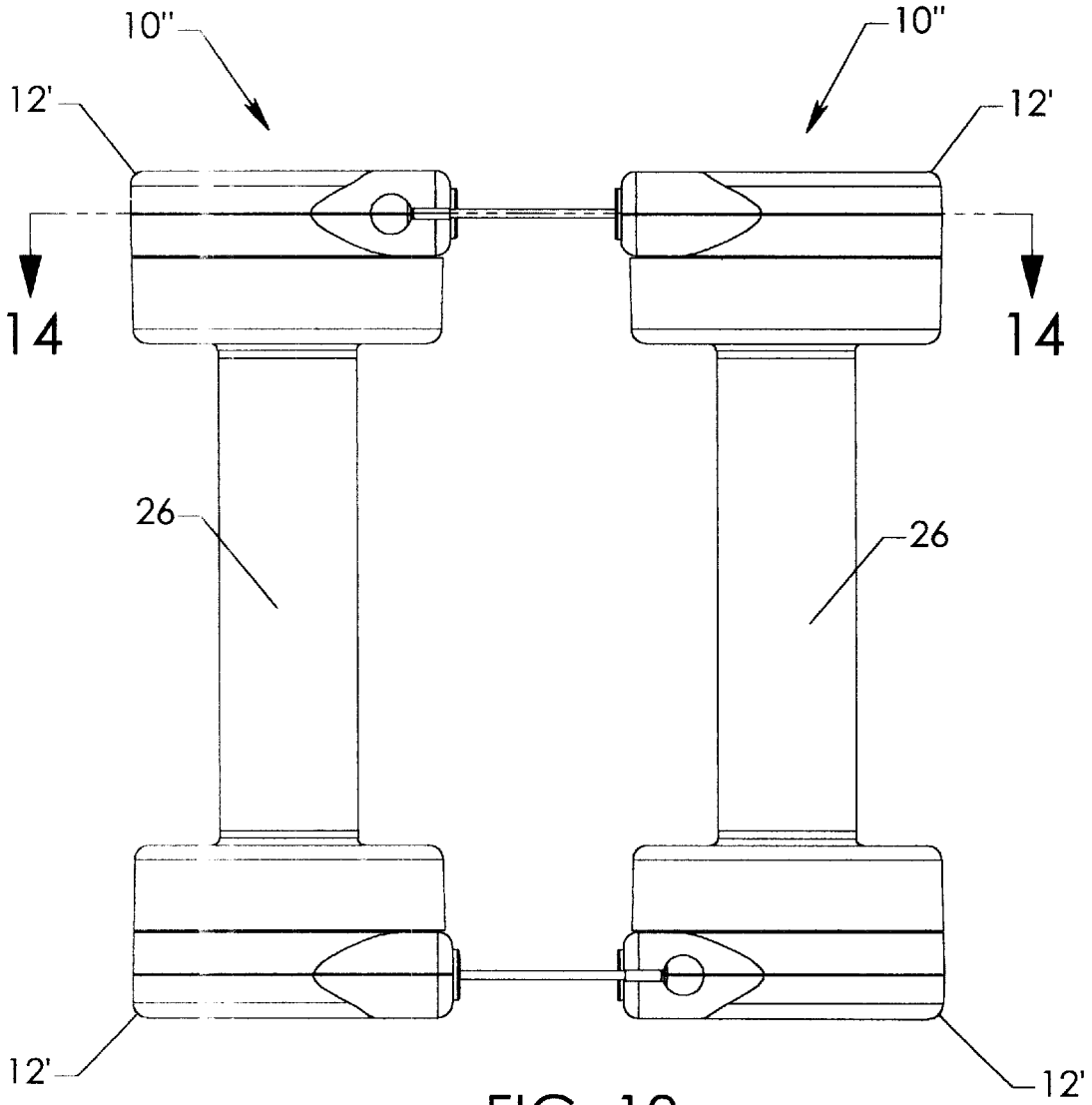
FIG. 13 is side view of the second alternate embodiment.
Figure 17:
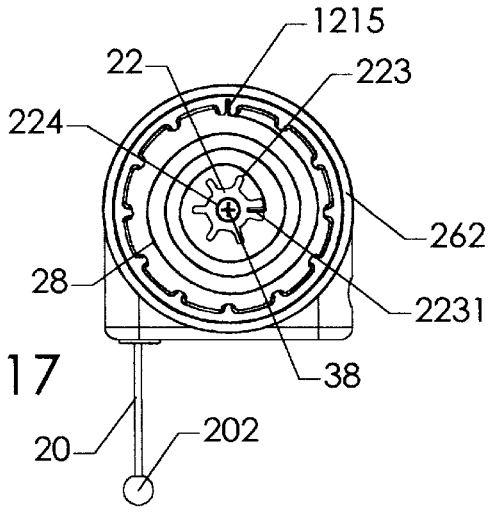
FIG. 17 is a sectional view along line 17—17 in FIG. 15.
Figure 16:
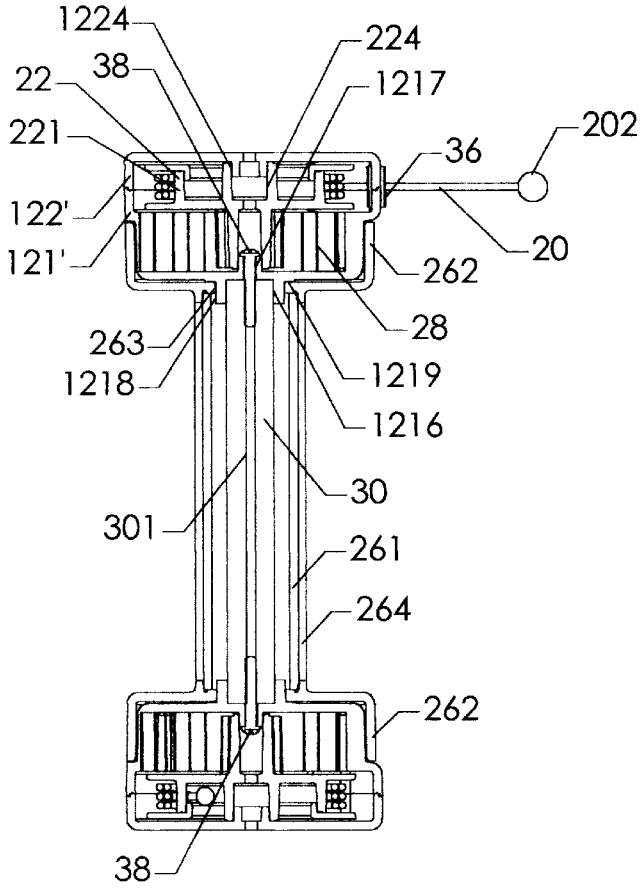
FIG. 16 is a sectional view along line 16—16 in FIG. 15.
Figure 15:
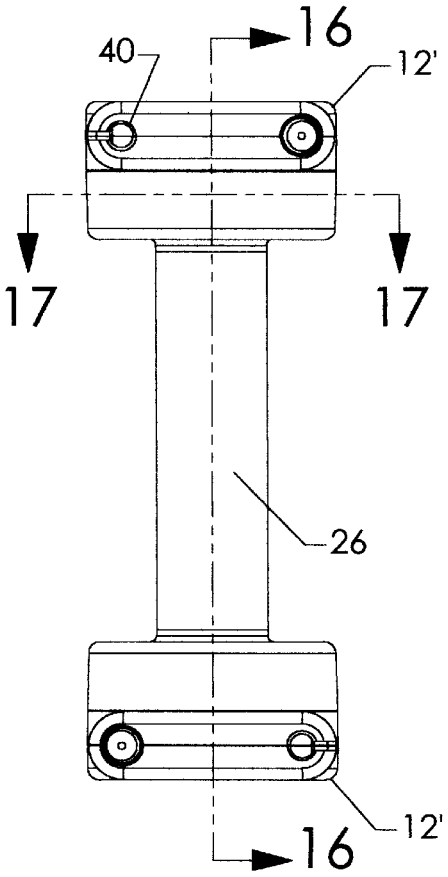
FIG. 15 is a front view of a handle assembly of the second alternate embodiment.
Figure 18:
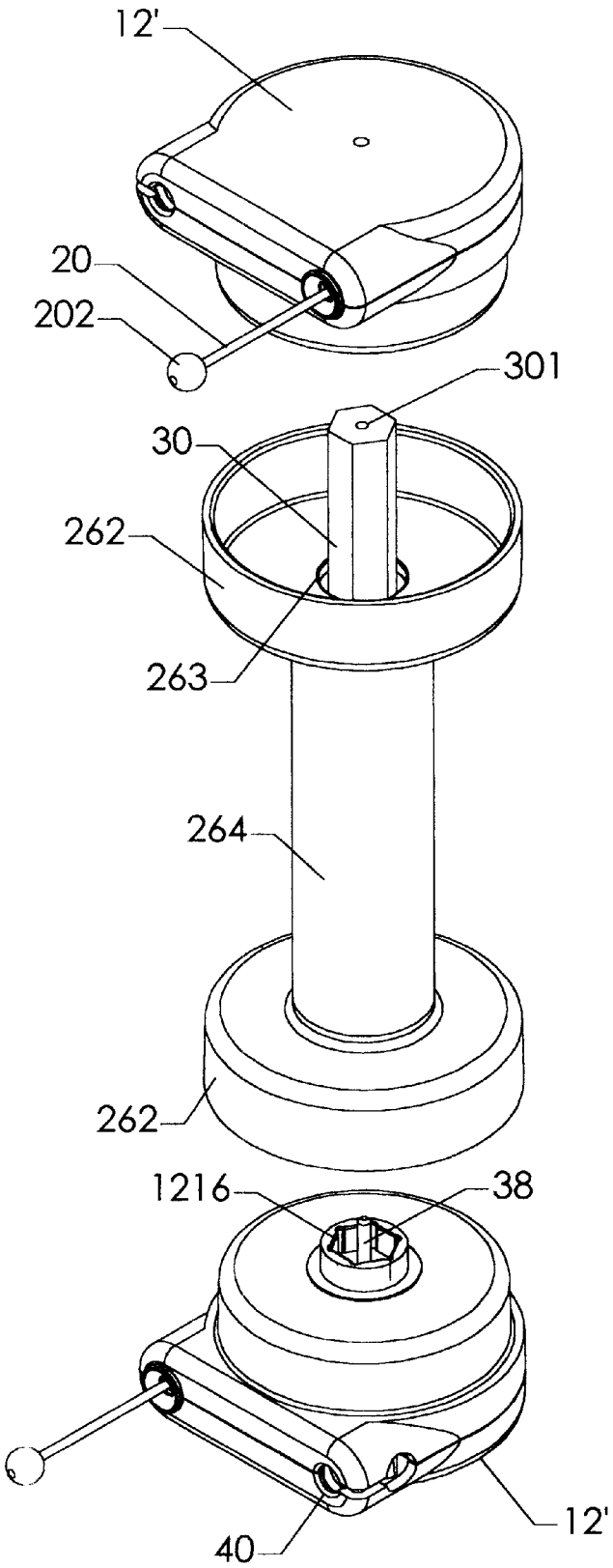
FIG. 18 is an exploded view of one of the handle assemblies of the second alternate embodiment.
Figure 19:
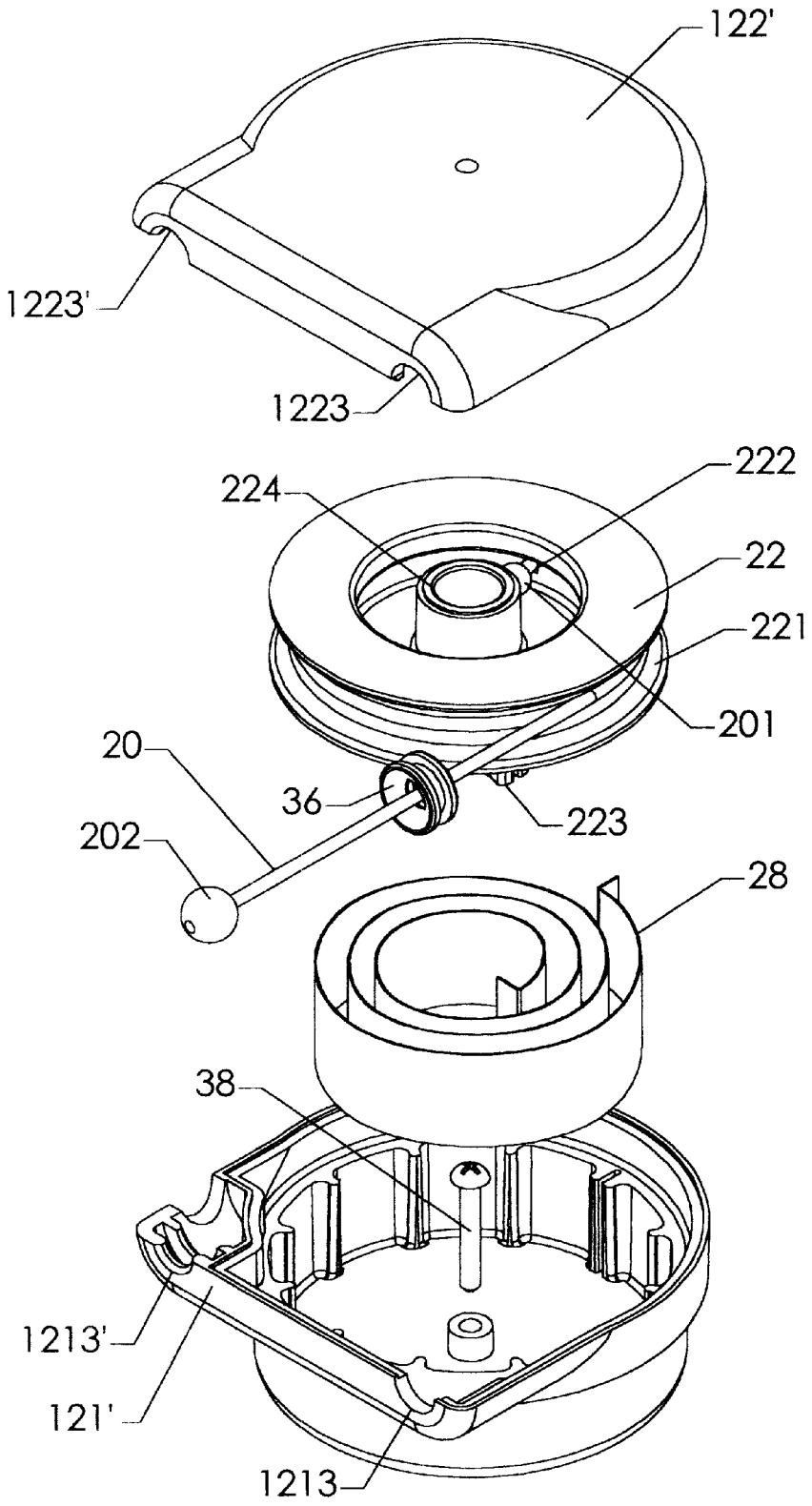
FIG. 19 is an exploded view of the head assembly of the first alternate embodiment.

FIGS. 10 and 11 illustrate a first alternate embodiment of the present invention. In this embodiment, two units of the hand weights 10' have two active heads 12 per unit. Each rope 20 can be joined in series to a second rope 20 by joining elements 203, 204. A joining element includes a first joining element 203 with a male threaded area, and a second joining element 204 with a female threaded area to receive the male thread of the first joining element 203.

With this embodiment, the user can perform exercises that are better performed with a longer range of motion. Since two of the ropes 20 are now utilized at each end of the hand weights 10', the range of motion is doubled. If the user desires to use the weights 10' separately, the user simply disconnects the joining elements 203, 204, and the weights 10' are independent from each other. Use of the first alternate weights 10' is otherwise identical to that of the first preferred embodiment weights 10.

Second Alternate Embodiment

A second alternate embodiment of the present invention is illustrated in FIGS. 12–19. The second alternate embodiment of the hand weights 10" also utilizes two active heads 12', similar to the first alternate embodiment. However with the second alternate embodiment, each rope 20 can be joined in parallel to a second rope 20, as opposed to the serial connection of the first alternate embodiment. The only difference in structure between the active heads 12 of the hand weights 10 of the preferred embodiment and the heads 12' of the hand weights 10" of the second alternate embodiment is that each of the heads 12' of the second alternate embodiment includes an anchoring means 40 for an outer end of a rope 20. Each head 12' therefore comprises a rotor 22 with a rope slot 222 to anchor an inner end of a first rope 20, a spring 28, and an anchoring means 40 to secure an outer end of a second rope 20.

Each head 12' is constructed from a inner head shell 121' and an outer head shell 122'. To form the anchoring means 40, a second semicircular hole 1213' is provided on the inner head shell 121', and a corresponding second semicircular hole 1223' is provided on the outer head shell 122'.

Operation of the second alternate embodiment of the device is identical to that of the preferred embodiment, but with the capacity for greater added resistance due to the fact that four ropes may be utilized as opposed to a maximum of two with the first preferred embodiment.

For operation of the device in the hand weight and rope pull mode, the primary mode of use for the device, the user begins by attaching the desired number of ropes between the pair of hand weights. From a standing position, one hand weight is gripped in each hand and held a short distance apart so that a short stretch of the rope(s) extends directly between the two handles. The user positions his forearms at 90° angles to his upper arms, with the elbows at the sides of his body. The user's forearms are held parallel to one another. The user extends one handle horizontally away from his body while pulling the other handle horizontally toward his body. After this extension, the motion of the arms is reversed so that the handles pass closely by one another in mid-stroke. This motion allows the springs to uncoil until the handles reach mid-stroke, then tighten again as the handles are pulled away from one another. The exercise is completed by repeating the motion in the reverse direction.

In a second mode of operation, the device can be used simply as hand weights, with no ropes connected. The user can perform the same exercise motion as described above, or he can perform any other exercise that makes use of handheld weights.

Finally, in a third mode of operation, the device can be used for various other rope pull exercises.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A hand weight and rope pull device comprising:

A pair of handheld weights, and at least one flexible linking member; wherein said handheld weights each comprise a handle section and two head assemblies attached to ends of said handle section, said handheld weights further comprise at least one resistance mechanism, and said handheld weights are connected by said flexible linking member, said flexible linking member being in communication with said resistance mechanism, and wherein said head assemblies are rotatably mounted on said handle section.

2. The hand weight and rope pull device of claim 1 wherein:

said resistance mechanism comprises a rotor mounted on a central bearing journal of at least one of said handheld weights, said rotor comprises a reel means to receive said flexible linking member, said rotor further comprises a spring means, a first end of said spring means being affixed to an arbor of said rotor, and a second end of said spring means being affixed to a head of said at least one of said handheld weights.

3. The hand weight and rope pull device of claim 1 wherein:

a joining element is affixed to an outer end of each said flexible linking member, such that when desired by a user, a first one of said flexible linking members is releasably connected to a second one of said flexible linking members, thereby doubling a length of said flexible linking member.

4. The hand weight and rope pull device of claim 3 wherein:

each said joining element includes a threaded area.

5. The hand weight and rope pull device of claim 1 wherein:

a connecting element is affixed to an outer end of each said flexible linking member, such that when desired by a user, a first one of said handheld weights is releasably connected to a second one of said handheld weights, thereby increasing a number of said flexible linking members utilized.

6. A hand weight and rope pull device comprising:

A pair of handheld weights, and at least one flexible linking member; wherein said handheld weights each comprise a handle section and two head assemblies attached to ends of said handle section, said handheld weights further comprise at least one resistance mechanism comprising a spiral wound spring, and said handheld weights are connected by said flexible linking member, said flexible linking member being in communication with said resistance mechanism, and wherein said head assemblies are rotatably mounted on said handle section.

7. The hand weight and rope pull device of claim 6 wherein:

said resistance mechanism comprises a rotor mounted on a central bearing journal of at least one of said handheld weights, said rotor comprises a reel means to receive said flexible linking member, said rotor further comprises a spring means, a first end of said spring means being affixed to an arbor of said rotor, and a second end of said spring means being affixed to a head of said at least one of said handheld weights.

* * * * *